US009302749B1

(12) United States Patent
D'Offay et al.

(10) Patent No.: US 9,302,749 B1
(45) Date of Patent: Apr. 5, 2016

(54) NON-SELF-PROPELLED FLOATABLE STRUCTURE PROVIDED WITH A STABILIZING SKIRT

(71) Applicants: Gerard Michel D'Offay, Fort Lauderdale, FL (US); Peter Nicholas Köhler, Fort Lauderdale, FL (US)

(72) Inventors: Gerard Michel D'Offay, Fort Lauderdale, FL (US); Peter Nicholas Köhler, Fort Lauderdale, FL (US)

( * ) Notice: Subject to any disclaimer, the term of this patent is extended or adjusted under 35 U.S.C. 154(b) by 0 days.

(21) Appl. No.: 14/257,674

(22) Filed: Apr. 21, 2014

Related U.S. Application Data

(63) Continuation-in-part of application No. 13/297,448, filed on Nov. 16, 2011, now Pat. No. 8,702,461, which is a continuation-in-part of application No. 12/952,686, filed on Nov. 23, 2010, now abandoned, which is a continuation-in-part of application No. 12/104,824, filed on Apr. 17, 2008, now Pat. No. 7,837,526, and a continuation-in-part of application No. 12/050,725, filed on Mar. 18, 2008, now Pat. No. 7,867,049.

(60) Provisional application No. 60/951,491, filed on Jul. 24, 2007.

(51) Int. Cl.
*B63B 35/58* (2006.01)
*B63B 7/00* (2006.01)

(52) U.S. Cl.
CPC .. *B63B 35/58* (2013.01); *B63B 7/00* (2013.01)

(58) Field of Classification Search
CPC ..... B63B 35/58; B63B 7/08; B63B 7/082; B63B 35/00; B63B 35/73; B63B 35/79; B63B 35/85; B63C 9/04; B63C 9/08
USPC ..... 441/40, 129; 114/345
See application file for complete search history.

(56) References Cited

U.S. PATENT DOCUMENTS

| | | | | |
|---|---|---|---|---|
| 2,453,155 | A | 11/1948 | Nelson et al. | |
| 3,566,425 | A | 3/1971 | Welty | |
| 4,517,914 | A * | 5/1985 | Geracitano | 441/40 |
| 5,215,031 | A | 6/1993 | Inman et al. | |
| 5,460,113 | A | 10/1995 | Gunter | |
| 5,546,885 | A | 8/1996 | Porada | |
| 5,613,457 | A | 3/1997 | Frank et al. | |
| 5,662,506 | A * | 9/1997 | Reinhardt et al. | 441/40 |
| 6,066,016 | A | 5/2000 | Yonover | |
| 6,460,583 | B1 | 10/2002 | Lindal | |
| 6,475,048 | B2 | 11/2002 | Gredy | |
| 6,805,066 | B2 | 10/2004 | Johnson | |

(Continued)

*Primary Examiner* — Lars A Olson
(74) *Attorney, Agent, or Firm* — H. John Rizvi; Gold & Rizvi, P.A.

(57) ABSTRACT

A non-self-propelled, floatable structure for supporting people, animals, machinery or other loads is disclosed, having a floatable body designed to float on water, and a retention skirt that protrudes downwardly from a peripheral edge of the floatable body. The retention skirt is designed to extend underwater, delimiting an internal space between the retention skirt, the floatable body, and the water. The retention skirt is airtight, preventing air passing through the skirt and towards said internal space. Thus, when a downward force is applied on an edge of the floatable body causing the opposite edge to start rising from the water, skirt airtightness beneath the rising edge creates a vacuum effect that stops the edge from rising and prevents the floating structure from swaying excessively and eventually turning over or capsizing. The retention skirt also limits or prevents lateral and transverse motion across the water surface.

19 Claims, 6 Drawing Sheets

(56) References Cited

U.S. PATENT DOCUMENTS 7,146,923 B2 12/2006 Polley et al.
7,322,309 B2 1/2008 Larochelle et al.
7,357,688 B2 4/2008 Ferrara

* cited by examiner

NON-SELF-PROPELLED FLOATABLE STRUCTURE PROVIDED WITH A STABILIZING SKIRT

CROSS-REFERENCE TO RELATED APPLICATION

This application is a Continuation-In-Part claiming benefit of U.S. Non-Provisional patent application Ser. No. 13/297,448, filed on Nov. 16, 2011, which is a Continuation-In-Part and claims the benefit of U.S. Non-Provisional patent application Ser. No. 12/952,686, filed on Nov. 23, 2010, now abandoned, which is a Continuation-In-Part and claims the benefit of U.S. Non-Provisional patent application Ser. No. 12/104,824, filed on Apr. 17, 2008, now issued as U.S. Pat. No. 7,837,526, which is a Continuation-In-Part of and claims priority to U.S. Non-Provisional patent application Ser. No. 12/050,725, filed on Mar. 18, 2008, now issued as U.S. Pat. No. 7,867,049, which claims priority to U.S. Provisional Patent Application Ser. No. 60/951,491, filed on Jul. 24, 2007, all of which are incorporated herein in their entireties.

FIELD OF INVENTION

The present invention relates to floating structures, and more particularly to a non-self-propelled floating structure, raft, dock, deck, platform, barge, marine hazard marker, marine navigational marker, life raft, commercial marine craft, recreational marine craft or the like having a bottom perimetric skirt that increases the structure's stability in the water, greatly reducing the risk of the structure tilting excessively, turning over or capsizing, and limiting or preventing lateral or transverse movement of the floating structure along the water.

BACKGROUND OF THE INVENTION

Floating structures may come in a myriad of shapes and sizes, depending on their function. Some floating structures, such as boats and ships, are self-propelled and thus capable of providing a means of transportation on water. Other floating structures such as floating docks, decks, platforms, rafts, landing crafts or the like, are generally not self-propelled, and are conceived to provide a static horizontal surface on which to carry out a wide variety of tasks or actions, depending on the type of structure. Many non-self-propelled floating structures are either inflatable, or are constructed from durable buoyant materials both of which are designed to support the weight of one or more individuals, heavy machinery or extreme loads, and to remain afloat. Such floating structures come in a variety of shapes, and sizes, and are generally used in recreational and utility activities such as swimming, boating, construction, repair or marine operations. Some floating structures comprise floating rafts or platforms that provide a base structure for swimmers to utilize. Still other floating structures comprise floating docks or decks that are fixedly positioned in one location on the surface of the water, and are used for walking upon, for water sports, or for securely attaching a boat or vessel in place.

Self-propelled floating structures are normally provided with a hull, which is a relatively complex watertight body designed to be arranged partially underwater and to render the structure hydrodynamic, stable, floatable and capable of sustaining a load. Static, non-self-propelled structures need not be as hydrodynamic but, instead, must be as stable and secure as possible to provide a safe environment for the person(s) standing or carrying out an activity on the structure, and for the load that is supported on the structure.

For instance, floating workstations are known in the art that are capable of providing a floating platform near a ship hull for a person to stand on and carry out repair, cleaning or other maintenance operations of the hull surface. Floating workstations are capable of easily changing positions relative to the vessel, allowing the person carrying out maintenance of the vessel to conveniently access and work on different zones of the hull, in comparison to carrying out the maintenance operations from a dock. Floating workstations of the sort must be as stable as possible to ensure safety of the persons and load supported on the workstation. In the event that such floating workstations are not adequately stable, inappropriate movement of the load or persons on the structure could cause the workstation to sway excessively, and even turn over, putting the person at risk of falling and suffering severe or fatal injuries, for instance in the event that the person impacts the ship hull, or marine structures, a seawall, hazardous waters or a hazardous sub-surface (seabed or riverbed).

In order to increase stability, some floating structures are provided with poles that are stuck into the underwater floor surface. While effective, such a solution is cumbersome to carry out, and requires the provision of lengthy and/or bulky hardware. In addition, it is not applicable when the floating structure is floating in deep waters.

The present invention seeks to provide a system for stabilizing a non-self-propelled floating structure, which is effective in preventing that the floating structure turns over relative to the water surface in both deep and shallow waters, and yet presents a reasonable cost that will allow the system to be successfully installed in a wide variety of non-self-propelled floating structures.

SUMMARY OF THE INVENTION

The present invention overcomes the deficiencies of the known art and the problems that remain unsolved by providing a non-self-propelled, floatable structure comprising a floatable body designed to float on water, and a retention skirt provided about a perimeter of the floatable body, the retention skirt being configured to extend into the water a predetermined distance and to prevent air from entering in the space delimited by the skirt, the body and the water surface. In the event that, while the structure is floating in water and supporting a load, the floatable structure is unstabilized by an undue movement of the load or an external force, a vacuum effect is created in the aforementioned space that prevents the structure from separating from the water, and thus from eventually turning over. In addition, the skirt also reduces, and in some cases prevents, the lateral or transverse movement of the floatable structure, further increasing stability of the load supported on the structure. The stabilizing retention skirt is equally valid and effective in both deep and shallow waters.

In accordance with a first embodiment of the invention, the present invention consists of a non-self-propelled, floatable structure for supporting a load, comprising:

a floatable body, configured to float on water, said body comprising a first side for remaining over the water, and a second side for contacting the water, wherein said second side is arranged opposite to said first side;

a retention skirt, protruding from said second side of said floatable body and configured to extend underwater, an internal space being delimited between said retention skirt said the second side, wherein said retention skirt is airtight for air passing in an inward direction, said inward direction corresponding to air passing through the skirt and towards said internal space.

In a second aspect, the skirt protrudes vertically downwards from the second side.

In another aspect, the retention skirt is at least partially flexible.

In another aspect, the retention skirt is at least partially rigid.

In another aspect, the floatable structure comprises at least one one-way air valve mechanism allowing air to exit the internal space and preventing air from entering the internal space.

In another aspect, at least one one-way air valve mechanism is comprised in the floatable body, allowing air to exit the internal space through the floatable body.

In another aspect, the one-way air valve mechanism comprised in the floatable body communicates the internal space with the first side of the floatable body.

In another aspect, the one-way air valve mechanism comprised in the floatable body comprises a one-way check valve.

In another aspect, the one-way air valve mechanism comprises a first end of the skirt and an opposed second end of the skirt, wherein said first end is externally overlapped over said second end, the first end being movable with respect to the second end, said first end being configured to separate from the second end responsive to an increase in air pressure in the internal space, and to rest against the second end responsive to a decrease in air pressure in the internal space.

In another aspect, the retention skirt is an entirely flexible skirt having overlapped first and second ends forming said one-way valve mechanism.

In another aspect, the retention skirt is removably attached to the floatable body.

In another aspect, the height of the retention skirt is manually or mechanically adjustable.

In accordance with another embodiment of the invention, the present invention consists of a non-self-propelled, floatable structure for supporting a load, comprising:

a floatable body, configured to float on water, said body comprising a top surface for supporting a load, and a bottom surface for facing the water;

a retention skirt, protruding downwards from a peripheral edge of said floatable body, an internal space being delimited between said retention skirt and said bottom surface, wherein said retention skirt is airtight for air passing in an inward direction, said inward direction corresponding to air passing through the skirt and towards said internal space;

at least one one-way air valve mechanism allowing air to exit the internal space and preventing air from entering the internal space in the event that the structure is placed on water and the internal space is enclosed between the bottom surface, the retention skirt, and the water.

In another aspect, at least one one-way air valve mechanism is comprised in the floatable body, allowing air to exit the internal space through the floatable body.

In another aspect, the one-way air valve mechanism comprises a first end of the skirt and an opposed second end of the skirt, wherein said first end is externally overlapped over said second end, the first end being movable with respect to the second end, said first end being configured to separate from the second end responsive to an increase in air pressure in the internal space, and to rest against the second end responsive to a decrease in air pressure in the internal space.

In another aspect, the retention skirt is an entirely flexible skirt having overlapped first and second ends forming said one-way valve mechanism.

In another aspect, the retention skirt is removably attached to the floatable body.

In accordance with yet another embodiment of the invention, the present invention consists of a non-self-propelled, floatable structure for supporting persons, animal or cargo, comprising:

a floatable body, configured to float on water, said body comprising a downward facing side for facing the water;

a retention skirt, protruding from said downward facing side of said body and configured to be arranged inside the water when the floatable structure is placed in the water, said retention skirt encircling an internal space, said internal space being delimited between said retention skirt and said downward facing side, wherein said retention skirt is airtight for air passing in an inward direction, said inward direction corresponding to air passing through the skirt and towards said internal space;

at least one one-way air valve mechanism allowing air to exit the internal space and preventing air from entering the internal space in the event that the structure is placed in the water and the internal space is enclosed between the bottom surface, the retention skirt, and the water.

In another aspect, at least one one-way air valve mechanism is comprised in the floatable body, allowing air to exit the internal space through the floatable body.

In another aspect, the one-way air valve mechanism comprises a first end of the skirt and an opposed second end of the skirt, wherein said first end is externally overlapped over said second end, the first end being movable with respect to the second end, said first end being configured to separate from the second end responsive to an increase in air pressure in the internal space, and to rest against the second end responsive to a decrease in air pressure in the internal space.

In another aspect, the retention skirt is an entirely flexible skirt having overlapped first and second ends forming said one-way valve mechanism.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

One or more embodiments of the present invention are disclosed herein. It will be understood that the claims and embodiments of the present invention are intended to be coextensive with each other, and that the embodiments are merely exemplary of the invention that may be embodied in various and alternative forms. It is noted that, according to common practice, the various features, elements and dimensions of particular embodiments are not to scale, and may be expanded, exaggerated or minimized for clarity. Thus, specific structural and functional details, dimensions, shapes, or configurations disclosed herein are not limiting but serve as a basis for teaching a person of ordinary skill in the art the described and claimed features of embodiments of the present invention.

Figure 1:
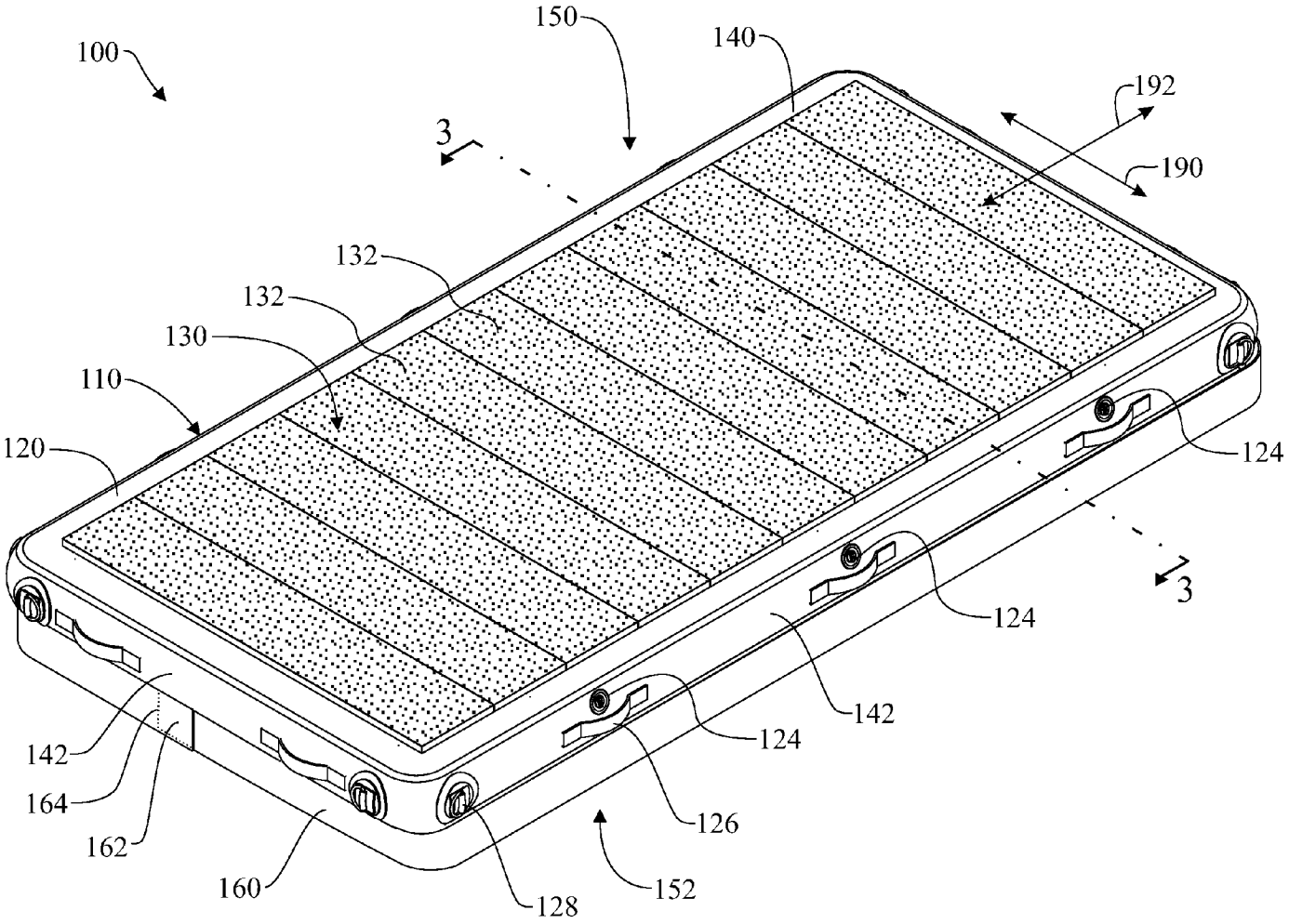
FIG. 1 presents a top perspective view of an exemplary floatable structure provided by a flexible perimetral skirt, according to one embodiment of the present invention.
Figure 2:
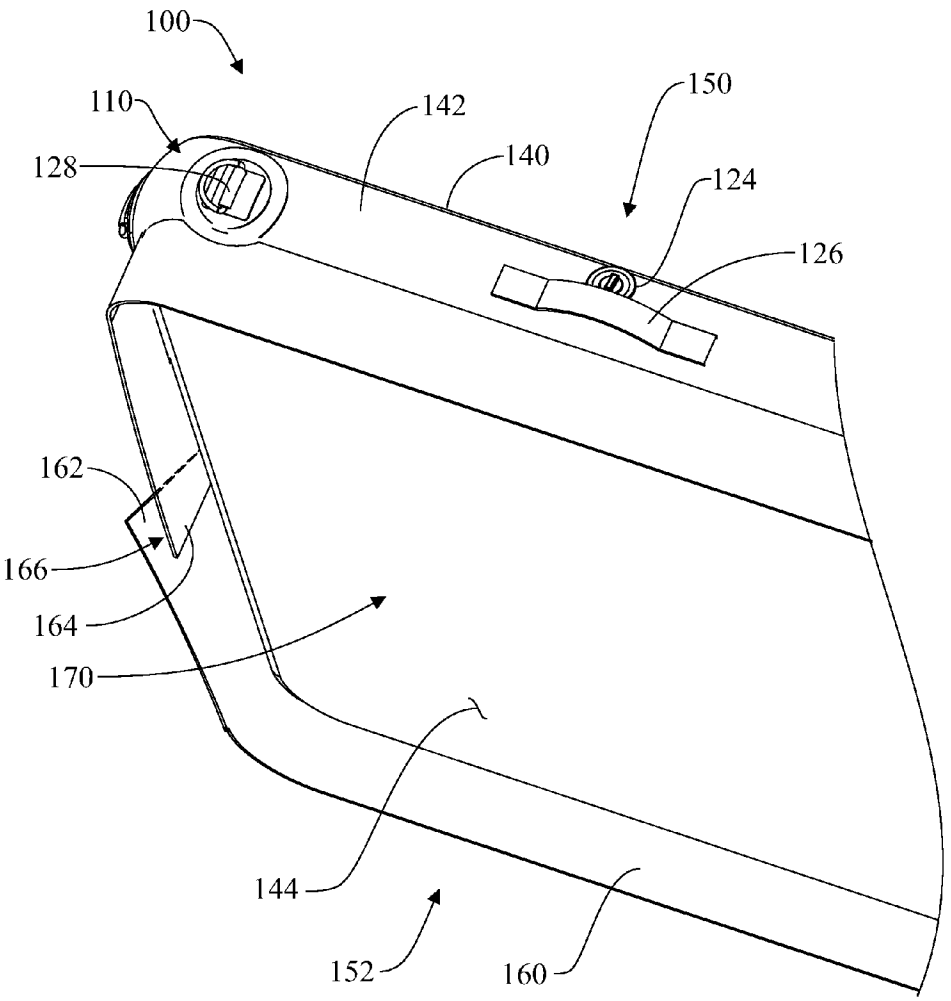
FIG. 2 presents a partial bottom perspective view of the floatable structure of FIG. 1, showing the skirt overlap area in a partially open position.
Figure 3:
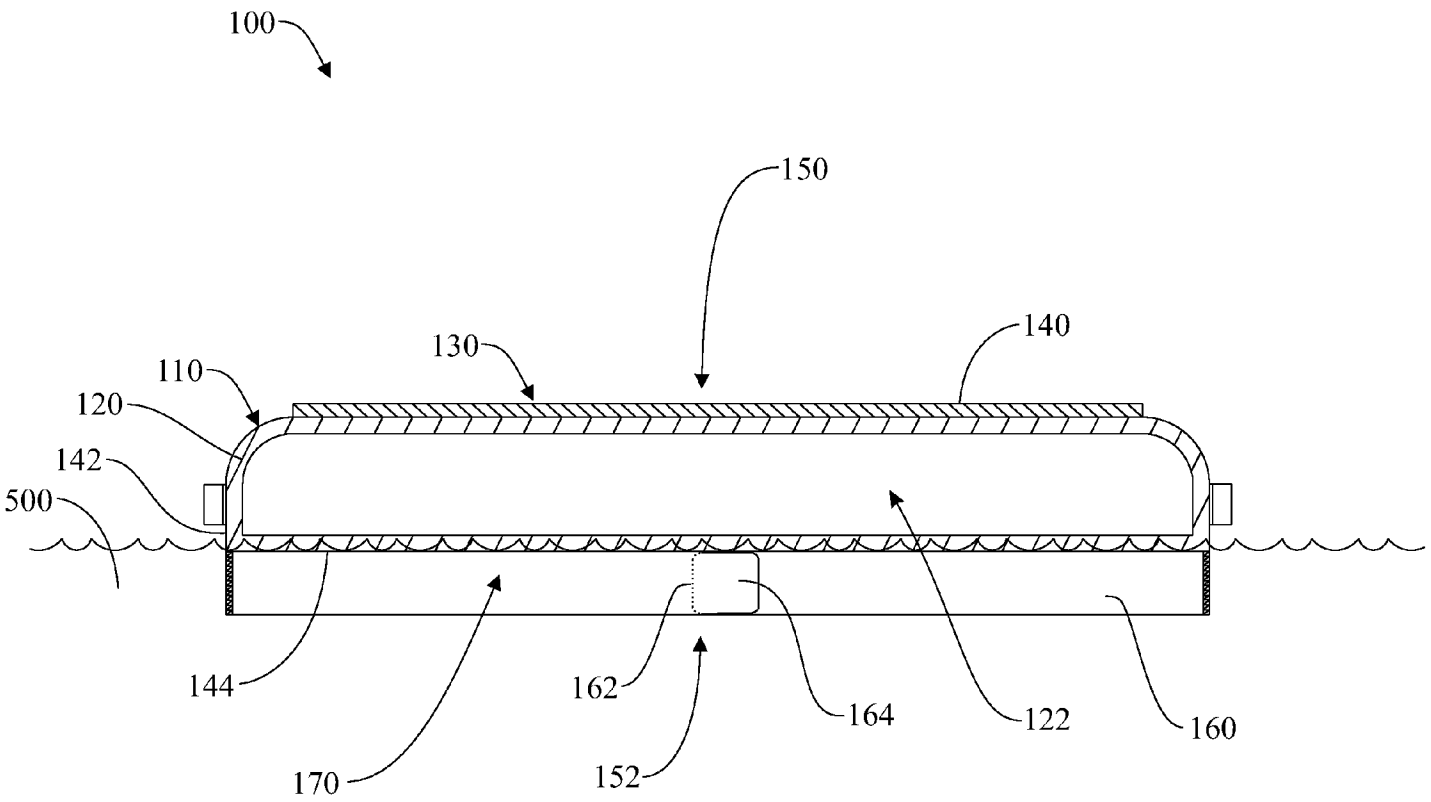
FIG. 3 presents a transverse cross-sectional view of the floatable structure of FIG. 1, placed in a rest position on the water, where the section has been carried out according cross-sectional plane 3-3 indicated in FIG. 1.

Referring now to the drawings wherein like reference characters designate like or corresponding parts throughout the several views, there is shown in FIGS. 1 through 3 an exemplary floatable assembly or structure 100 according to one embodiment of the present invention. As best shown in FIG. 1, the floatable structure 100 of the present embodiment is essentially flat and rectangular in shape, and includes an inflatable floatable body 110 configured to float on water. For this purpose, the floatable body 110 of the present embodiment comprises a raft-like plastic inflatable body 120 on which a platform 130 is arranged. The inflatable body 120 is a flexible bladder provided with one or more internal chambers 122 (as best shown in FIG. 3) that can be filled with gas in order to render the structure 100 floatable; in the event of there being more than one internal chamber 122, the chambers 122 will be separated by internal partitions (not shown in the figures as they are not of relevance to the present invention). Turning again to FIG. 1, several inflation/deflation valves 124 are provided in gaseous communication with the floatable body internal chamber or chambers 122 for filling, retaining, and removing gas from within each respective internal chamber 122. In addition, a series of handles 126 facilitate manipulation of the floatable body 110, and a series of side corner fastening members 128 to which ropes, straps or chains can be secured for pulling the structure or securing it to a dock or the like. The platform 130, in turn, provides a firm standing surface or floor for stably supporting a load, such as cargo, tools, machinery, people or animals; said surface is preferably non-slip to ensure that the worker retains solid footing while standing thereon, and to ensure that load in general does not slide along the platform when wet. The platform 130 is composed of a plurality of panels 132 in parallel alignment, adequately connected to form a joint assembly. The platform 130 can be attached to the inflatable body 120 by various means well known by those skilled in the art, such as an adhesive material arranged between the platform 130 and the inflatable body 120, by a dense hook and loop attachment, by rubber cement, by heat welding, by high-frequency electrical welding techniques, by mechanical fitting of the platform 130 into the inflatable body 120 so that the platform 130 is partially embraced by the inflatable body 120, or by a combination thereof.

As shown in FIGS. 1 and 2, the floatable body 110 of the present embodiment presents a top surface 140, sidewalls 142, and a bottom surface 144. The top surface 140 is provided by the platform 130. The sidewalls 142 and the bottom surface 144 are provided by the inflatable body 120. The top surface 140 and sidewalls 142 are arranged on a first side 150 of the floatable body 110, whereas the bottom surface 144 is arranged on a second side 152 of the floatable body 110. In the present embodiment, as shown in FIG. 3, the first side 150 is configured to remain above water level when the floatable structure 100 is placed in the water 500, whereas the second side 152 is configured not only to face but also to contact the water 500. In the embodiment shown, the bottom surface 144 of the second side 152 rests entirely and flatly on the water 500. However, alternative embodiments are contemplated in which the bottom surface 144 of the second side 152 is not a simple flat surface but has a more complex design, featuring recesses and/or protuberances, in such a way that some air spaces can be defined between the bottom surface 144 and the water 500 surface.

The floatable structure 100 is not self-propelled, i.e., is not designed to provide an autonomous means of transportation, but rather to provide a static support for a person to stand on and carry out an activity (such as repairing a vessel hull outer surface) or for holding cargo.

In accordance with the invention, the floatable structure 100 further comprises a retention skirt 160 that protrudes downwardly from the second side 152 of the floatable body 110. As shown in FIGS. 2 and 3, an internal space 170 is delimited between the retention skirt 160 and the second side 152 of the floatable body 110. The retention skirt 160 is sized and shaped to extend underwater. In a non-limiting example, a floatable structure 100 having a width and depth of 6-10 feet could be provided with an 8-inch high retention skirt 160. It is contemplated that, in general, the retention skirt can have any applicable height or length.

The retention skirt 160 forms a continuous wall capable of extending downwardly into a body of water. The retention skirt 160 is airtight for air passing in an inward direction, towards the internal space 170. In other words, the retention skirt 160 material(s) and construction provide inward airtightness. For instance, the retention skirt can be manufactured as a flexible sheet of PVC material. Or, in another non-limiting example, the retention skirt can be manufactured from a metallic sheet.

Figure 4:
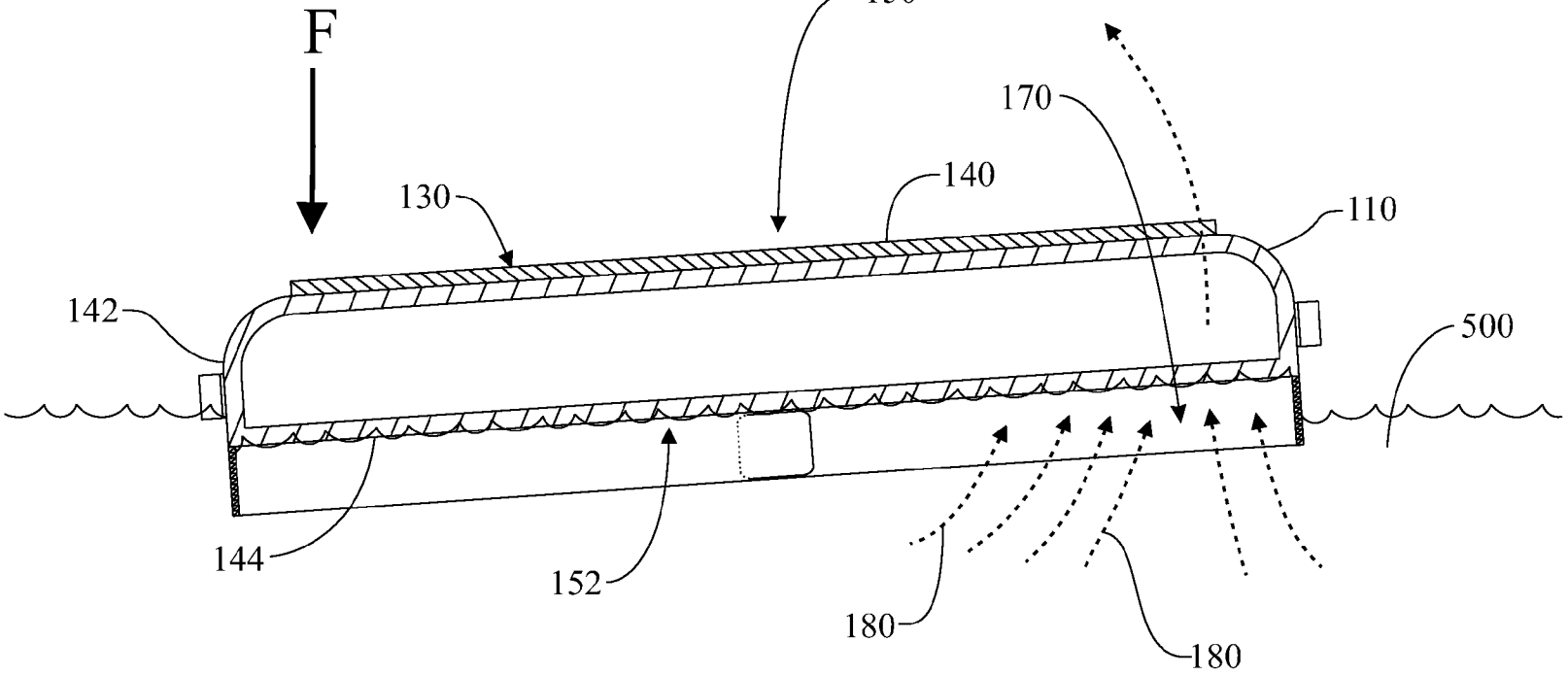
FIG. 4 presents the floatable structure of FIG. 3, in a situation in which a load is being applied on an edge of the floatable body, causing the floatable structure to tilt.

The illustration of FIG. 4 shows the floatable structure 100 of FIG. 3 in a situation in which a sudden force F is applied in a downward direction near an edge of the floatable body first side 150. For instance, the downward force F could be the weight of a load or person suddenly being exerted on the edge of the platform 130. Because the force F is exerted near the edge of the floatable body 110, the force F tends to cause a rotation movement of the floatable body 110 and, thus, the opposite edge of the floatable body 110 is pushed upwards as shown in the figure, and begins to rise upwards. In this situation in which the opposite edge of the floatable body 110 has begun to rise upwards, the retention skirt 160 is still partially underwater, thereby enclosing the internal space 170 between the water 500 and the second side 152 of the floatable body 110. In this scenario, the inwardly airtight retention skirt 160 prevents air from entering from the outside of the retention skirt 160 into the enclosed internal space 170. In consequence, as the floatable body 110 begins to rise, a vacuum or negative pressure effect is created in the internal space 170, causing the rising floatable body 110 to suction water 500 upwards as indicated schematically by arrows 180. The weight of the water 500 that is lifted upwards counteracts force F and prevents the floatable body 110 from rising further, thus stabilizing the floatable body 110. Thus, as has been demonstrated, the retention skirt 160 as per the invention delivers an automatic and very effective stabilizing effect at reasonable cost.

Figure 5:
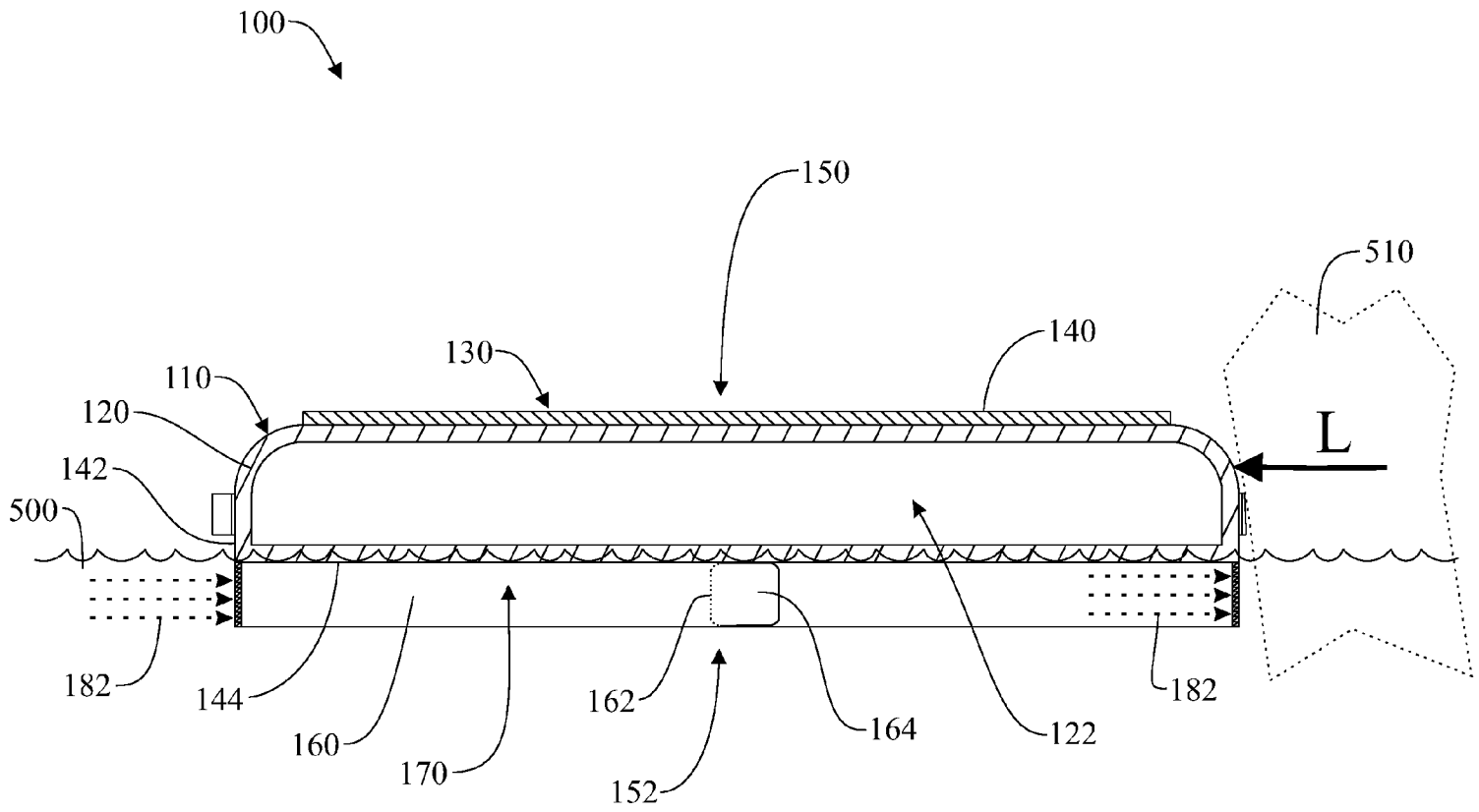
FIG. 5 presents the floatable structure of FIG. 3, in a situation in which a lateral force is being applied on the floatable body.

In addition, the retention skirt 160 provides a dragging or stopping effect for displacement of the floatable structure 100 along the water surface, due to the fact that the retention skirt 160 is submerged in water 500 either vertically or with a strong vertical component, and poses a strong resistance to water moving relative to the retention skirt 160 in a lateral direction (indicated by arrow 190 in FIG. 1), a transverse direction (indicated by arrow 192 in FIG. 1) or a combination thereof, i.e. in any horizontal direction. The drag effect contributes to stability and safety of the persons and load standing on the floatable structure 100. In order to illustrate this drag effect, FIG. 5 shows the floatable structure 100 of FIG. 3 in a situation in which a lateral force L is being applied on the floatable structure 100, for instance by an external mass or body 510. The external body 510 has been depicted only schematically as its precise shape or nature is not relevant. As can be observed, when lateral force L is applied on the floatable structure 100, retention skirt 160 exerts a drag or fluid resistance to lateral water movement (water movement indicated by arrows 160) and thus reduces or prevents lateral movement of the floatable structure 100 along the water 500. This drag effect is dependent on the velocity of water and thus increases when the lateral force L increases. The drag effect is also stronger if the retention skirt 160 is entirely rigid.

Preferably, the retention skirt 160 protrudes vertically downwards from the second side 152 of the floatable body 110 when the floatable structure 100 is in a rest position as shown in FIG. 3, for a more integrated and compact configuration of the floatable structure 100. However, alternative embodiments are contemplated in which the retention skirt extends at a non-square angle from the bottom surface 144 of the floatable body 110 or is arranged non-vertically with respect to the water 500 surface level.

It is contemplated that the retention skirt can be partially or entirely flexible, or partially or entirely rigid.

As has been mentioned, the retention skirt 160 is inwardly airtight, i.e., prevents air from passing through the retention skirt 160 towards the internal space 170. Optionally, the floatable structure can comprise at least one one-way air valve mechanism allowing air to exit the internal space 170 while also preventing air from entering the internal space 170. Such a solution allows one-way expelling of air from the internal space 170 to outside the retention skirt 160. Thus, when the floatable structure 100 is placed in the water, the floatable body 110 presses the air in the internal space 170 and the compressed air is gradually expelled from the internal space 170 though the at least one one-way air valve mechanism until the bottom surface 144 contacts and rests on the water 500 surface. Thus, having at least one one-way air valve mechanism allowing outward airflow promotes initial stability of the floatable structure 100.

The embodiment shown in FIGS. 1 through 5 shows a first example of a one-way air valve mechanism preventing inward airflow and allowing outward airflow from the internal space 170. Specifically, the one-way air valve mechanism comprises a first end 162 of the retention skirt 160 and an opposed second end 164 of the retention skirt 160, wherein the first end 162 is externally overlapped over the second end 164 as best shown in FIGS. 1 and 2. In addition, the first end 162 is movable with respect to the second end 164, and is configured to separate from the second end 164 responsive to an increase in air pressure in the internal space 170 relative to the air pressure outside the retention skirt 160, and to rest against the second end 164 responsive to a decrease in air pressure in the internal space 170 relative to the air pressure outside the retention skirt 160. When the floatable structure 100 is placed in the water 500 and the internal space 170 becomes enclosed between the water 500, the retention skirt 160 and the bottom surface 144 of the floatable body 110, causing air pressure to rise due to the floatable structure 100 weight, air pressure pushes the first end 162 outwards and opens a gap 166 between the first end 163 and the second end 164, as best shown in FIG. 2; the gap 166 provides a passageway for air to exit the internal space 170 as has been explained. Such an arrangement of overlapping ends or portions of the skirt provides an automatic one-way valve effect that is constructively simple and inexpensive to manufacture, yet extremely effective.

The retention skirt can be provided with a variable number of one-way air valve mechanisms. However, in a preferred embodiment, the retention skirt 160 is an entirely flexible band of flexible material, as shown in FIGS. 1 and 2, the band having overlapped first and second ends 162, 164 forming a single one-way valve mechanism. Such a construction provides optimum cost-effectiveness and performance. It is understood that the position of the valve mechanism(s) along the retention skirt may vary in different embodiments of the invention.

The invention further contemplates that the retention skirt 160 can be removably attached to the floatable body 110, to facilitate displacement of the floatable structure 100 along the water in the event that the structure needs to be transported or pulled to a different location. Thus, a detachable retention skirt 160 not only serves the purpose of the present invention (i.e. stabilizing the floatable body 110) but also does not prevent the floatable body 110 from being pulled along the water 500 if need be.

In addition, it is further contemplated that the retention skirt 160 can be manually or mechanically raised or lowered, in order to adjust the retention skirt height. Vertical adjustability allows regulating the degree to which the skirt penetrates in the water body, and thus regulating the intensity of both the rotational and transverse stabilization effects of the retention skirt. In the event that the floatable structure is to remain static in the body of water, the skirt can be lowered to provide maximum stability; if, however, the floatable body is to be pulled and transported along the water, the retention skirt can be raised to reduce its lateral and transverse drag effect.

Figure 6:
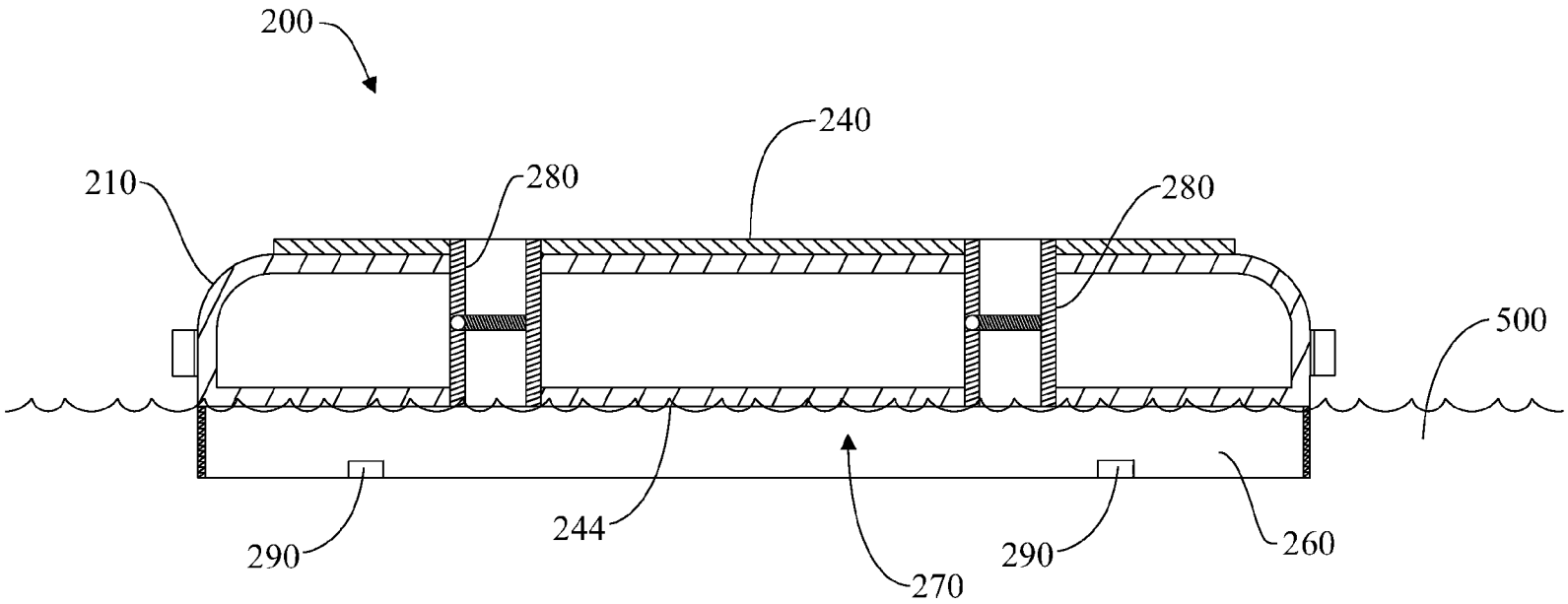
FIG. 6 presents a transverse cross-sectional view of a second embodiment of a floatable structure in accordance with the invention, provided with a one-way check valve.

The illustration of FIG. 6 shows an alternative embodiment of the invention, consisting in a non-self-propelled, floatable structure 200 for supporting a load, comprising a floatable body 210, configured to float on water, said body comprising a top surface 240 for supporting a load, and a bottom surface 244 for facing or contacting the water. The floatable body 210 of the present embodiment is a single, solid piece of foam. As in the previous embodiment, the floatable structure 200 comprises a retention skirt 260 protruding downwards from a peripheral edge of said floatable body 210. An internal space 270 is delimited between the retention skirt 260 and the bottom surface 244. The retention skirt 260 is airtight for air passing in an inward direction, the inward direction corresponding to a direction in which air were to pass through the retention skirt 260 and towards the internal space 270. In addition, the floatable structure 200 includes several one-way air valve mechanisms preventing air from entering the internal space 270 in the event that the structure is placed on water and the internal space 270 is enclosed between the bottom surface 244, the retention skirt 260, and the water, and allowing air to exit the internal space 270 in the event of a pressure increase in the internal space 270. In this alternative embodiment, the one-way air valve mechanisms through which air can exit the internal space 270 are comprised in the floatable body 210. Such an arrangement allows, for instance, for the retention skirt 260 to be rigid and lacking movable portions and ends. Specifically, the one-way air valve mechanisms comprised in the floatable body 210 communicate the internal space 270 with the first side top surface 240 of the floatable body 210, producing a very fast and efficient air evacuation. In this specific embodiment, the one-way air valve mechanisms comprised in the floatable body 210 are one-way check valves 280.

In addition, weights 290 can be included along the retention skirt 260 to retain the skirt in a desired configuration, in order to guarantee its stabilizing and braking effect in the event of disturbed waters.

In the embodiments shown, the retention skirt 160, 260 protrudes downwards from a peripheral edge of the floatable body, in order to maximize the internal space 170, 270 enclosed within the retention skirt 160, 260. However, alternative embodiments are contemplated in which the retention skirt 160, 260 is arranged differently, for instance along an intermediate portion of the bottom surface 144, 244 of the floatable body 110, 210, and not along a peripheral edge. In addition, alternative embodiments are contemplated in which the floatable structure comprises more than one retention skirt, in order to include separate internal spaces.

The floatable structure and floatable body could present various configurations other than that of the illustrated embodiment. In general, the floatable structure can be a raft, dock, deck, platform, barge, marine hazard marker, marine navigational marker, life raft, commercial marine craft, recreational marine craft, or the like. In turn, the floatable body may comprise a variety of different shapes and sizes, including square, round, or elliptical. The floatable body may be fabricated from any one of hyperlon, PVC, a plastic, a synthetic, vinyl, rubber, foam rubber, fabric, mesh, or nylon material coated or laminated with a polymer, polymeric, or polyurethane material, wood, fibers, wood derivatives, cork, lightweight metal, heavyweight metal or any combination thereof. It will be noted that the floatable body may include internal beams, supports, ribs or reinforcement materials that are structurally integrated within or about the floatable body to provide structural strength, stability and rigidity.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A non-self-propelled, floatable structure for supporting a load, comprising:

a floatable body, configured to float on water, said body comprising a first side for remaining over the water, and a second side for contacting the water, wherein said second side is arranged opposite to said first side;

a retention skirt, protruding from said second side of said floatable body and configured to extend underwater, an internal space being delimited between said retention skirt said the second side, wherein said retention skirt is airtight for air passing in an inward direction, said inward direction corresponding to air passing through the skirt and towards said internal space; and at least one one-way air valve mechanism allowing air to exit the internal space and preventing air from entering the internal space.

2. The non-self-propelled, floatable structure of claim 1, wherein the skirt protrudes vertically downwards from the second side.

3. The non-self-propelled, floatable structure of claim 1, wherein the retention skirt is at least partially flexible.

4. The non-self-propelled, floatable structure of claim 1, wherein the retention skirt is at least partially rigid.

5. The non-self-propelled, floatable structure of claim 1, wherein the floatable body comprises at least one one-way air valve mechanism configured to allow air to exit the internal space through the floatable body.

6. The non-self-propelled, floatable structure of claim 5, wherein the one-way air valve mechanism comprised in the floatable body communicates the internal space with the first side of the floatable body.

7. The non-self-propelled, floatable structure of claim 5, wherein the one-way air valve mechanism comprised in the floatable body comprises a one-way check valve.

8. The non-self-propelled, floatable structure of claim 5, wherein the one-way air valve mechanism comprises a first end of the skirt and an opposed second end of the skirt, wherein said first end is externally overlapped over said second end, the first end being movable with respect to the second end, said first end being configured to separate from the second end responsive to an increase in air pressure in the internal space, and to rest against the second end responsive to a decrease in air pressure in the internal space.

9. The non-self-propelled, floatable structure of claim 8, wherein the retention skirt is an entirely flexible skirt having overlapped first and second ends forming said one-way valve mechanism.

10. The non-self-propelled, floatable structure of claim 1, wherein the retention skirt is removably attached to the floatable body.

11. The non-self-propelled, floatable structure of claim 1, wherein the height of the retention skirt is manually or mechanically adjustable.

12. A non-self-propelled, floatable structure for supporting a load, comprising:

a floatable body, configured to float on water, said body comprising a top surface for supporting a load, and a bottom surface fix facing the water;

a retention skirt, protruding downwards from a peripheral edge of said floatable body, an internal space being delimited between said retention skirt and said bottom surface, wherein said retention skirt is airtight for air passing in an inward direction, said inward direction corresponding to air passing through the skirt and towards said internal space;

at least one one-way air valve mechanism allowing air to exit the internal space and preventing air from entering the internal space in the event that the structure is placed on water and the internal space is enclosed between the bottom surface, the retention skirt, and the water.

13. The non-self-propelled, floatable structure of claim 12, wherein the floatable body comprises at least one one-way air valve mechanism configured to allow air to exit the internal space through the floatable body.

14. The non-self-propelled, floatable structure of claim 13, wherein the one-way air valve mechanism comprises a first end of the skirt and an opposed second end of the skirt, wherein said first end is externally overlapped over said second end, the first end being movable with respect to the second end, said first end being configured to separate from the second end responsive to an increase in air pressure in the internal space, and to rest against the second end responsive to a decrease in air pressure in the internal space.

15. The non-self-propelled, floatable structure of claim 14, wherein the retention skirt is an entirely flexible skirt having overlapped first and second ends forming said one-way valve mechanism.

16. The non-self-propelled, floatable structure of claim 12, wherein the retention skirt is removably attached to the floatable body.

17. A non-self-propelled, floatable re for supporting persons, animal or cargo, comprising:

a floatable body, configured to float on water, said body comprising a downward facing side for facing the water;

a retention skirt, protruding from said downward facing side of said body and configured to be arranged inside the water when the floatable structure is placed in the water, said retention skirt encircling an internal space, said internal space being delimited between said retention skirt and said downward facing side, wherein said retention skirt is airtight for air passing in an inward direction, said inward direction corresponding to air passing through the skirt and towards said internal space;

at least one one-way air valve mechanism allowing air to exit the internal space and preventing air from entering the internal space in the event that the structure is placed in the water and the internal space is enclosed between the bottom surface, the retention skirt, and the water.

18. The non-self-propelled, floatable structure of claim 17, wherein the floatable body comprises at least one one-way air valve mechanism configured to allow air to exit the internal space through the floatable body.

19. The non-self-propelled, floatable structure of claim 18, wherein the one-way air valve mechanism comprises a first end of the skirt and an opposed second end of the skirt, wherein said first end is externally overlapped over said second end, the first end being movable with respect to the second end, said first end being configured to separate from the second end responsive to an increase in air pressure in the internal space, and to rest against the second end responsive to a decrease in air pressure in the internal space.

* * * * *